US009554630B1

(12) United States Patent
Patel

(10) Patent No.: US 9,554,630 B1
(45) Date of Patent: Jan. 31, 2017

(54) BEACH UMBRELLA SYSTEM

(71) Applicant: Vinod Patel, Jacksonville, FL (US)

(72) Inventor: Vinod Patel, Jacksonville, FL (US)

( * ) Notice: Subject to any disclaimer, the term of this patent is extended or adjusted under 35 U.S.C. 154(b) by 0 days.

(21) Appl. No.: 14/873,418

(22) Filed: Oct. 2, 2015

Related U.S. Application Data

(63) Continuation-in-part of application No. 14/258,879, filed on Apr. 22, 2014.

(51) Int. Cl.

| | |
|---|---|
| ***A45B 25/02*** | (2006.01) |
| ***A45B 25/18*** | (2006.01) |
| *A45B 23/00* | (2006.01) |
| *A45B 25/00* | (2006.01) |

(52) U.S. Cl.
CPC ..... *A45B 25/02* (2013.01); *A45B 25/18* (2013.01); *A45B 2023/0012* (2013.01); *A45B 2025/003* (2013.01); *A45B 2200/1009* (2013.01); *A45B 2200/1054* (2013.01)

(58) Field of Classification Search
CPC ..... A45B 1/00; A45B 3/06; A45B 2009/002; A45B 2025/003; A45B 2200/1054; A47B 2220/008
USPC ..... 135/33.41, 35
See application file for complete search history.

(56) References Cited

U.S. PATENT DOCUMENTS

| | | | | | |
|---|---|---|---|---|---|
| 728,035 | A * | 5/1903 | Sprague | A45B 25/18 | 135/33.5 |
| 988,904 | A * | 4/1911 | Sprague | A45B 25/18 | 135/33.5 |
| 2,185,587 | A * | 1/1940 | Carlisle | A45B 25/02 | 135/33.5 |
| 2,211,283 | A * | 8/1940 | Mercer | E04H 12/2223 | 135/15.1 |
| 2,533,799 | A * | 12/1950 | Haydu | A45B 25/18 | 135/33.5 |
| 2,597,157 | A * | 5/1952 | Martino | A47G 25/08 | 126/30 |
| 3,194,403 | A * | 7/1965 | Van Horn, Jr. | A47F 5/04 | 211/107 |
| 3,323,654 | A * | 6/1967 | Lee | B01D 33/0009 | 210/404 |
| 4,089,416 | A * | 5/1978 | Sims | A45B 25/04 | 135/33.5 |
| 5,101,844 | A * | 4/1992 | Morrone | A45B 25/18 | 135/33.5 |

(Continued)

FOREIGN PATENT DOCUMENTS

| | | | | |
|---|---|---|---|---|
| AT | DE 202014102096 U1 * | 5/2015 | | A45B 25/18 |
| LU | DE 202011107747 U1 * | 2/2013 | | A45B 3/00 |
| NL | 1008036 C1 * | 7/1999 | | A45B 23/00 |

*Primary Examiner* — David R Dunn
*Assistant Examiner* — Danielle Jackson

(57) ABSTRACT

An umbrella has a lower pole and an upper pole and a fabric. The lower pole includes screw threads. A spring clip in an inverted V-shaped configuration has outwardly extending projections removably coupling together the upper pole and the lower pole. A handle is removably coupled to the lower pole to twist the lower pole. Each rib of a plurality of ribs has an interior end and an exterior end. The interior ends of the ribs are coupled to the upper pole. The fabric overlies the ribs. Each tip of a plurality of tips has an upper part and a lower part. Each upper part has a tubular recess receiving the exterior end of an associated rib. The periphery of the fabric is secured between the upper part and the lower part.

3 Claims, 6 Drawing Sheets

(56) References Cited

U.S. PATENT DOCUMENTS 5,156,369 A * 10/1992 Tizzoni ..... E04H 12/32 135/16
5,161,561 A * 11/1992 Jamieson ..... A45B 3/00 108/94
5,293,889 A * 3/1994 Hall ..... A45B 3/00 135/16
5,529,083 A * 6/1996 Martin ..... A45B 25/18 135/31
5,678,586 A * 10/1997 Baksh ..... A45B 25/22 135/28
6,032,880 A * 3/2000 Verrills ..... E04H 12/2223 248/156
6,085,766 A * 7/2000 Geary ..... A01B 1/00 135/68
6,199,569 B1 * 3/2001 Gibson ..... E04H 12/2223 135/16
6,487,977 B1 * 12/2002 Williams ..... A45B 23/00 108/150
6,612,320 B2 * 9/2003 Lin ..... E04H 12/2238 135/33.41
6,675,819 B2 * 1/2004 Arrowood ..... A45F 3/44 135/118
7,191,996 B2 * 3/2007 Patsalaridis ..... E04H 12/2223 135/16
7,264,210 B2 * 9/2007 Yu ..... A45F 3/44 135/16
7,475,859 B2 * 1/2009 Selders ..... A45B 3/06 211/107
7,836,903 B2 * 11/2010 Kharag ..... A45B 11/00 135/25.31
7,950,200 B2 * 5/2011 Tropiano ..... E04H 12/2223 135/98
8,191,561 B2 * 6/2012 Brooks, III ..... E04H 12/2223 135/16
8,272,605 B2 * 9/2012 Fuchs ..... A45B 19/04 248/122.1
2004/0129184 A1 * 7/2004 Kraker ..... A45B 25/00 108/50.12
2005/0279391 A1 * 12/2005 Brooks, III ..... A45B 3/00 135/16
2006/0272687 A1 * 12/2006 Tanner ..... E04H 12/2223 135/16
2007/0137681 A1 * 6/2007 Tatz ..... A45B 3/06 135/16
2007/0246091 A1 * 10/2007 Becker ..... A45B 3/00 135/16

* cited by examiner

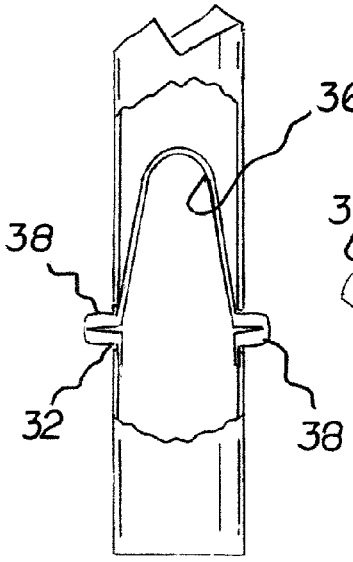
FIG. 4
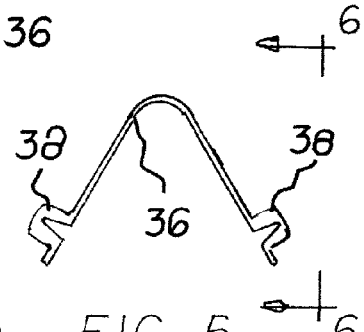
FIG. 5
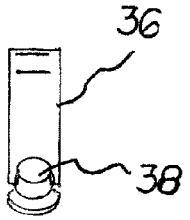
FIG. 6
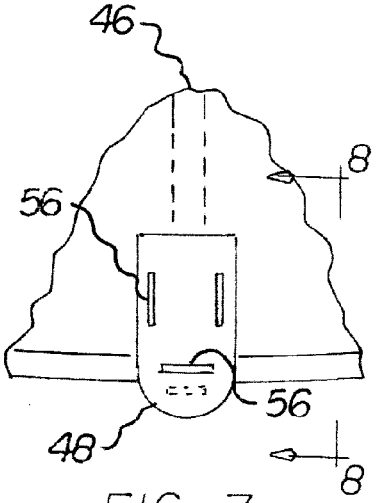
FIG. 7
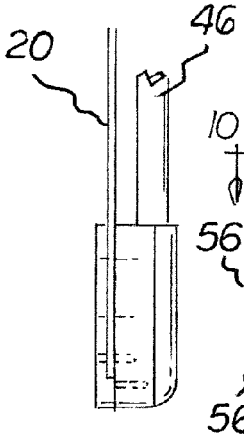
FIG. 8
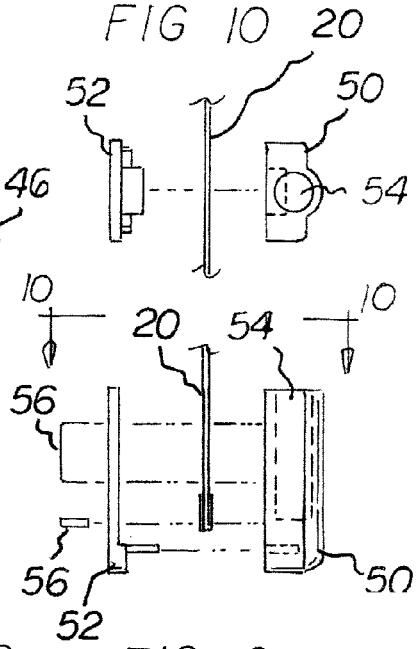
FIG 10
FIG. 9

FIG. 13
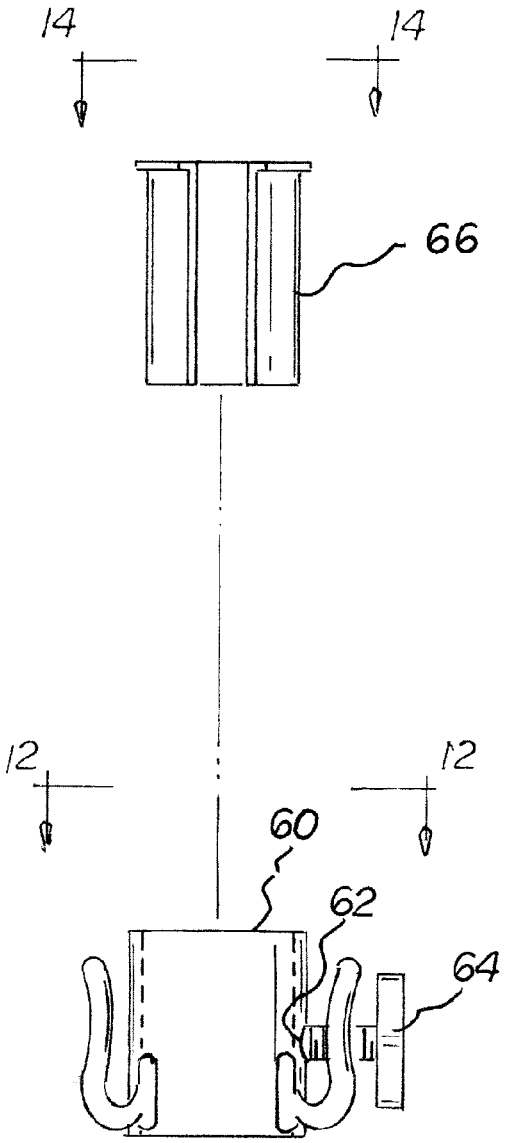
FIG. 11
FIG. 14
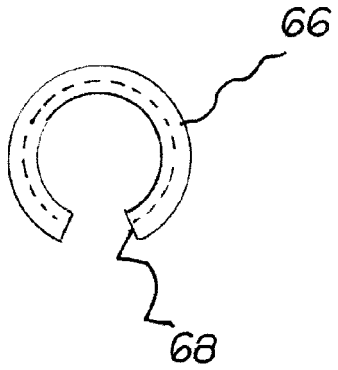
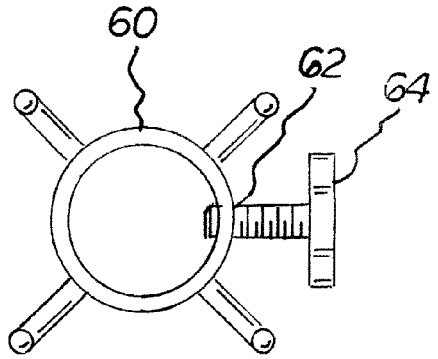
FIG. 12

FIG. 18
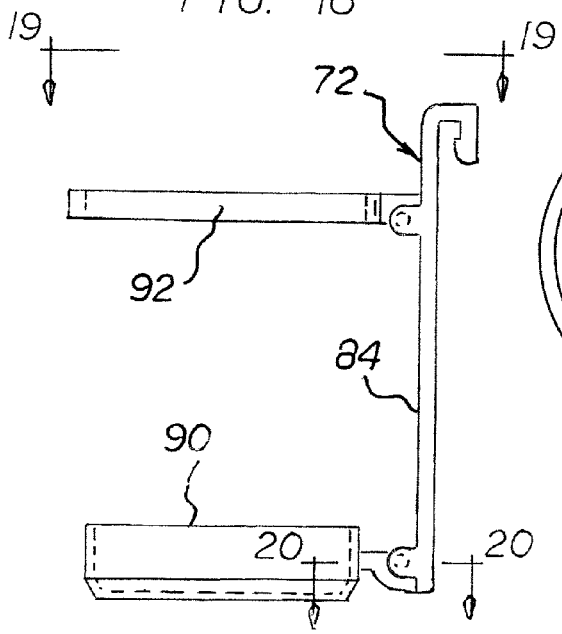
FIG. 19
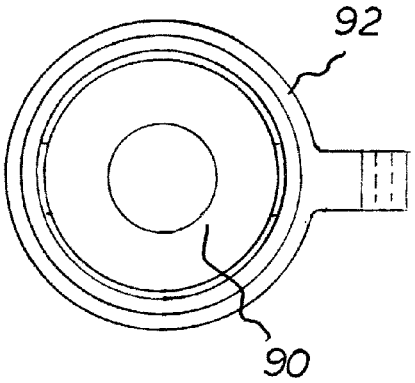
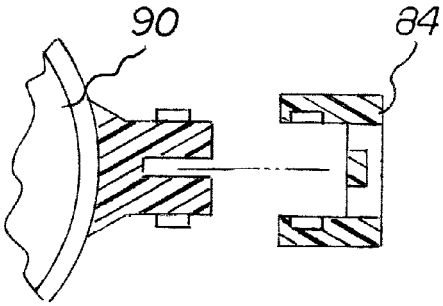
FIG. 20
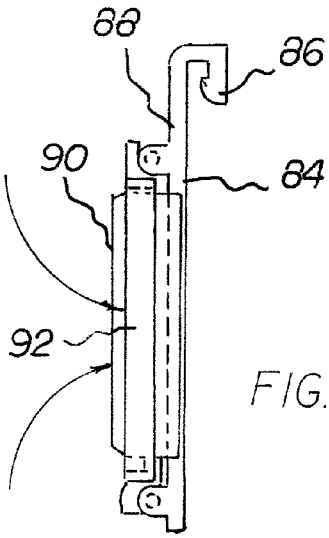
FIG. 21

BEACH UMBRELLA SYSTEM

RELATED APPLICATION

The present invention is a continuation-in-part of pending application Ser. No. 14/258,879 filed Apr. 22, 2014, the subject matter of which is incorporated herein by reference.

BACKGROUND OF THE INVENTION

Field of the Invention

The present invention relates to a beach umbrella system and more particularly pertains to providing shade at a beach, deploying rapidly, and supporting leisure articles, in a safe, convenient, and economical manner.

Description of the Prior Art

The use of beach umbrellas of known designs and configurations is known in the prior art. More specifically, beach umbrellas of known designs and configurations previously devised and utilized for the purpose of providing shade at the beach are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a beach umbrella system that allows providing shade at a beach, deploying rapidly, and supporting leisure articles, in a safe, convenient, and economical manner.

In this respect, the beach umbrella system according to the present invention substantially departs from the conventional concepts and designs of the prior art, and in doing so provides an apparatus primarily developed for the purpose of providing shade at a beach, deploying rapidly, and supporting leisure articles, in a safe, convenient, and economical manner.

Therefore, it can be appreciated that there exists a continuing need for a new and improved beach umbrella system which can be used for providing shade at a beach, deploying rapidly, and supporting leisure articles, in a safe, convenient, and economical manner. In this regard, the present invention substantially fulfills this need.

SUMMARY OF THE INVENTION

In view of the foregoing disadvantages inherent in the known types of beach umbrellas of known designs and configurations now present in the prior art, the present invention provides an improved beach umbrella system. As such, the general purpose of the present invention, which will be described subsequently in greater detail, is to provide a new and improved beach umbrella system and method which has all the advantages of the prior art and none of the disadvantages.

To attain this, from a broad standpoint, the present invention essentially comprises an umbrella having a lower pole and an upper pole and a fabric. The lower pole includes screw threads. A spring clip in an inverted V-shaped configuration has outwardly extending projections removably coupling together the upper pole and the lower pole. A handle is removably coupled to the lower pole to twist the lower pole. Each rib of a plurality of ribs has an interior end and an exterior end. The interior ends of the ribs are coupled to the upper pole. The fabric overlies the ribs. Each tip of a plurality of tips has an upper part and a lower part. Each upper part has a tubular recess receiving the exterior end of an associated rib. The periphery of the fabric is secured between the upper part and the lower part.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved beach umbrella system which has all of the advantages of the prior art beach umbrellas of known designs and configurations and none of the disadvantages.

It is another object of the present invention to provide a new and improved beach umbrella system which may be easily and efficiently manufactured and marketed.

It is further object of the present invention to provide a new and improved beach umbrella system which is of durable and reliable constructions.

An even further object of the present invention is to provide a new and improved beach umbrella system which is susceptible of a low cost of manufacture with regard to both materials and labor, and which accordingly is then susceptible of low prices of sale to the consuming public, thereby making such beach umbrella system economically available to the buying public.

Even still another object of the present invention is to provide a beach umbrella system for providing shade at a beach, deploying rapidly, and supporting leisure articles, in a safe, convenient, and economical manner.

Lastly, it is an object of the present invention to provide a new and improved A beach umbrella system 10 for providing shade at a beach, for deploying rapidly, and for supporting leisure articles, the providing and deploying and supporting being done in a safe, convenient, and economical manner, the system comprising, in combination:

an umbrella 14 having a lower pole 16 and an upper pole 18 and a fabric 20, the lower pole formed with a lower end and including a lower insert 22, the lower insert being formed with screw threads 24 and fabricated of plastic, axial grooves 26 and axial projections 28 interfacing the lower pole and the lower insert to abate rotation between the lower pole and the lower insert, pins 30 coupling the lower pole and the lower insert to abate axial movement between the lower pole and the lower insert, interior holes 32 extending through the upper pole at a lower extent, exterior holes 34 extending through the lower pole at an upper extent, a spring clip 36 fabricated of spring steel in an inverted V-shaped configuration with outwardly extending projections 38 extending through the interior holes and the exterior holes to removably couple together the upper pole and the lower pole, drilling holes 40 extending through the lower pole beneath the spring clip, a handle 42 in a cylindrical configuration removably positioned through the drilling holes to twist the lower pole for insertion into the sand;

a plurality of ribs 46, each of the ribs having an interior end and an exterior end, the interior ends coupled to the upper pole at an upper extent, the exterior ends forming a generally circular configuration, the fabric 20 having a generally circular configuration overlying the ribs, the fabric having a periphery, a plurality of tips 48, each tip having an upper part 50 and a lower part 52, each upper part having a tubular recess 54 receiving the exterior end of an associated rib, the periphery of the fabric positioned between the upper parts and the lower parts respectively with staples 56 coupling together the lower part and the fabric and the upper part;

a collar 60 having a cylindrical configuration with an axial threaded aperture 62, a threaded bolt 64 extending through the axial threaded aperture of the collar to removably secure the collar to the upper pole beneath the ribs, a spacer 66 in a generally cylindrical configuration positionable between the upper pole and the collar to accommodate an upper pole of a smaller diameter, the spacer having an axial slot 68 for passage of the threaded bolt, a plurality of J-shaped hooks integrally formed with the collar adapted to support a variety of objects including towels, purses, cameras, and the like; and a plurality of drink holders 72, each drink holders including a supporting member 74, each supporting member having a C-shaped configuration for removable coupling frictionally to the lower pole beneath the spring clip, the support member having an upper enlargement 76 and a lower enlargement 78, two small C-shaped fingers 80, one small C-shaped finger coupled to the upper enlargement and one small C-shaped finger coupled to the lower enlargement, the small C-shaped fingers being axial aligned for removable receipt of the handle 42, the upper enlargement having diametric slots 82 extending vertically, two inverted J-shaped backings, each inverted J-shaped backing having a short leg 86 removably received in an associated slot, each inverted J-shaped backing having a long leg 88 extending below the lower enlargement, a circular base 90 pivotably coupled to each long leg below the lower enlargement, a circular ring 92 pivotably coupled to each long leg above the lower enlargement, each circular base and each circular ring being positioned horizontally during operation and use, each circular base being pivoted upwardly and each circular ring being pivoted downwardly during storage and transportation whereby each circular base is within an associated circular ring.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an enlarged showing of the lower extent of the upper pole with portions broken away to show certain internal constructions.

FIG. 5 is a front elevational view of the spring clip of FIG. 4.

FIG. 6 is an enlarged side elevational view of the spring clip taken at line 6-6 of FIG. 5.

FIG. 7 is a plan view of a tip coupling the fabric to one rib taken at circle 7 of FIG. 1.

FIG. 8 is a side elevational view of the tip and fabric and rib taken at line 8-8 of FIG. 7.

FIG. 9 is an exploded side elevational view of the components of FIG. 8.

FIG. 10 is an exploded plan view of the components of FIGS. 6, 7, 8, and 9 taken at line 10-10 of FIG. 9.

FIG. 11 is an enlarged front elevational view of the collar and hooks taken at circle 11 of FIG. 1.

FIG. 12 is a plan view taken along line 12-12 of FIG. 11.

FIG. 13 is an enlarged front elevational view of the insert taken at circle 11 of FIG. 1.

FIG. 14 is a plan view taken along line 14-14 of FIG. 13.

FIG. 18 is a side elevational view of one drink holder in an open orientation.

FIG. 19 is a plan view taken along line 19-19 of FIG. 18.

FIG. 20 is a cross sectional view taken along line 20-20 of FIG. 18.

FIG. 21 is an exploded side elevational view of one drink holder in an closed orientation.

The same reference numerals refer to the same parts throughout the various Figures.

DESCRIPTION OF THE PREFERRED EMBODIMENT

Figures 1, 2:
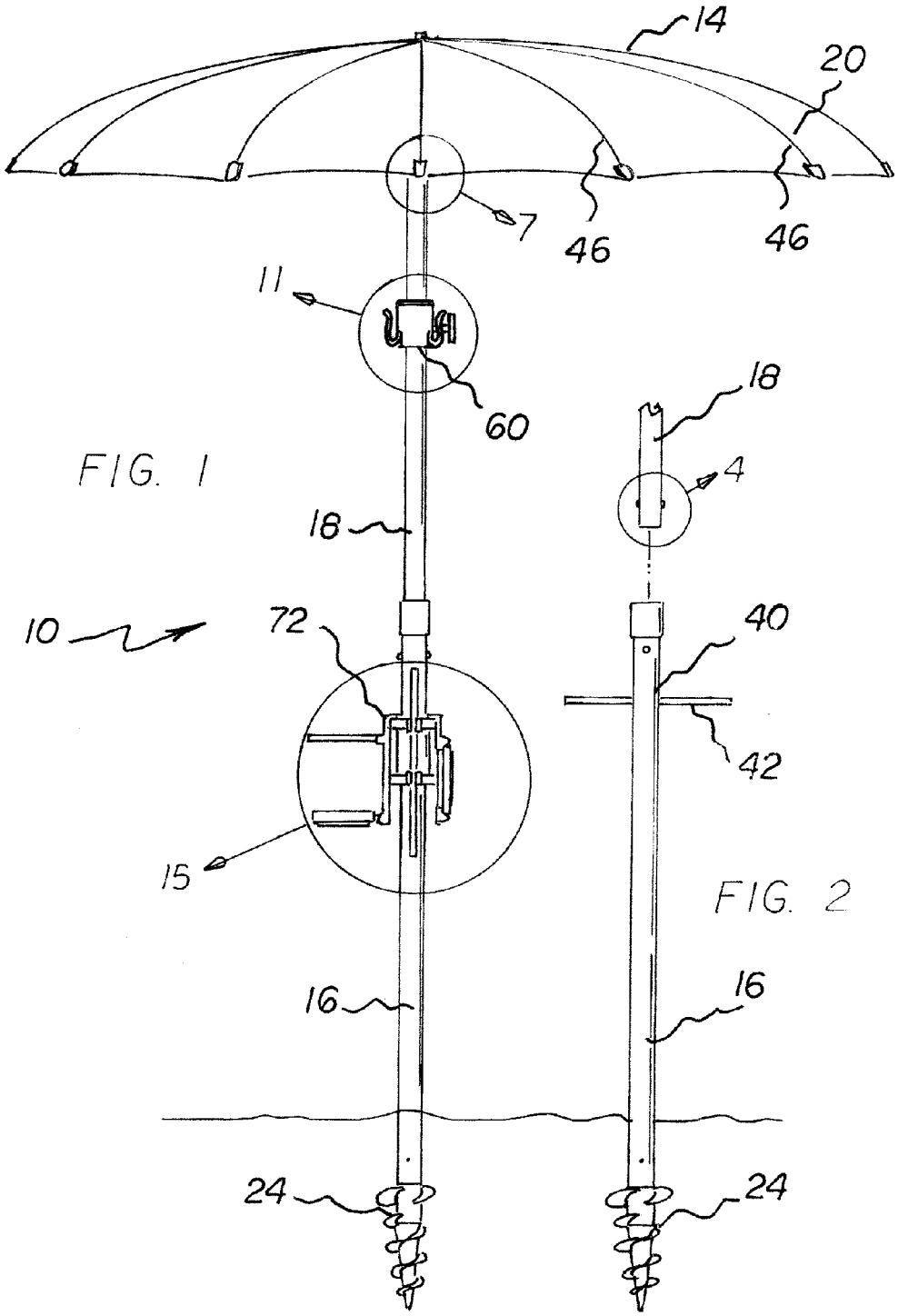
FIG. 1 is a front elevational view of a beach umbrella system constructed in accordance with the principles of the present invention.
FIG. 2 is an exploded front elevational view of the lower pole and part of the upper pole.
Figure 3:
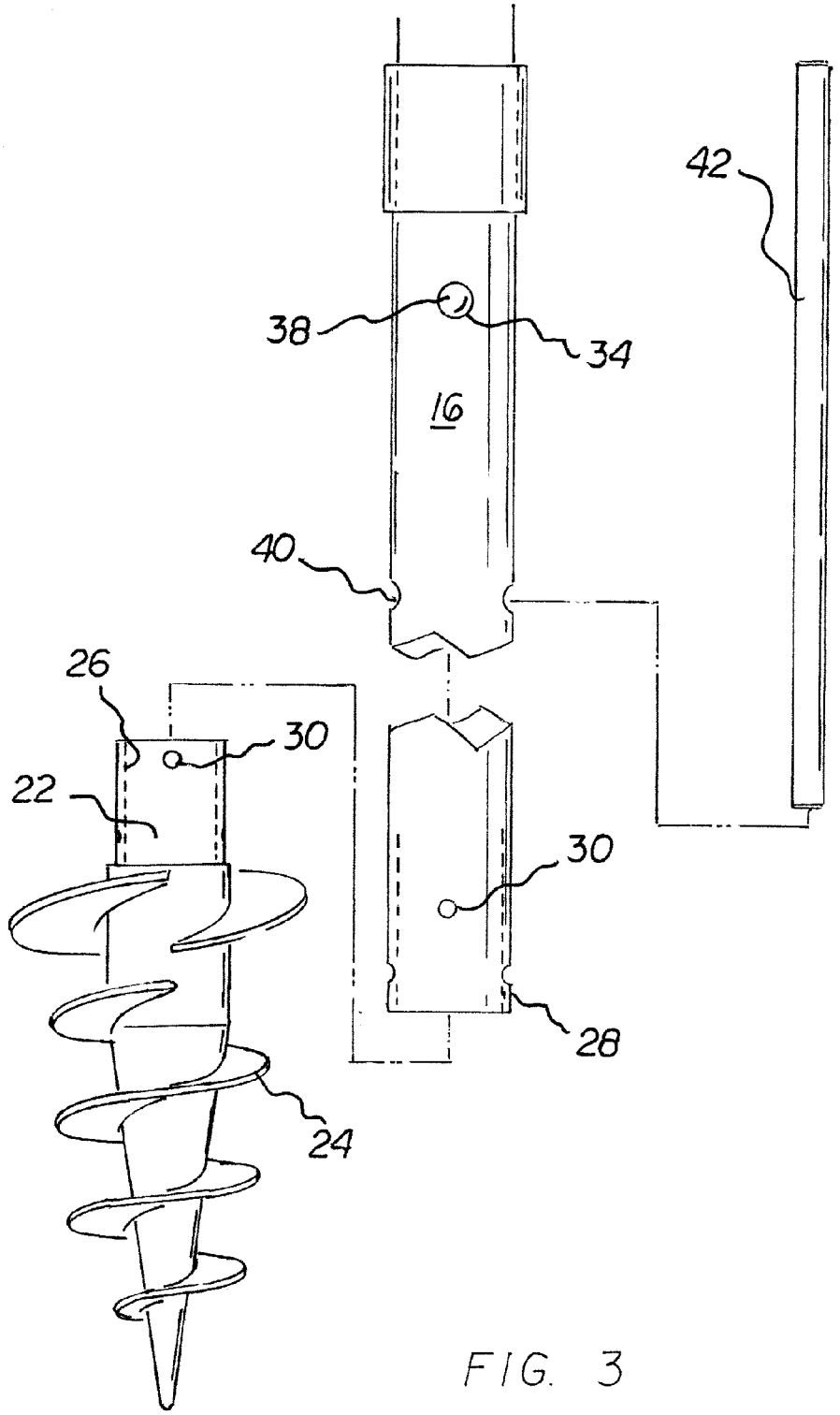
FIG. 3 is an exploded front elevational view of the lower pole and the handle.
Figure 15:
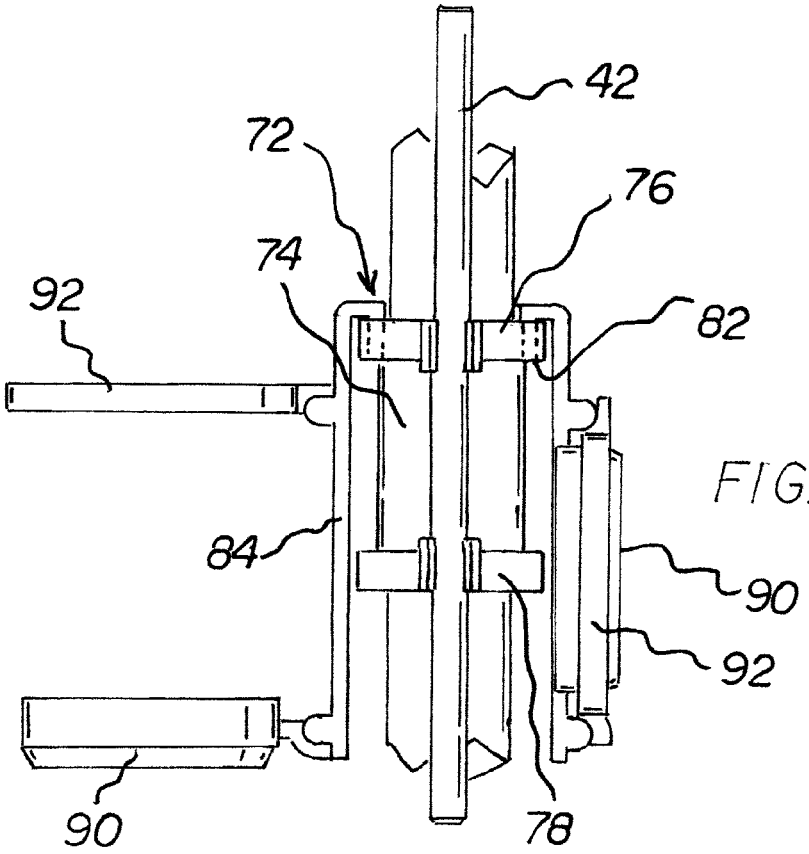
FIG. 15 is an enlarged front elevational view of the drink holders taken at circle 15 of FIG. 1.
Figure 16:
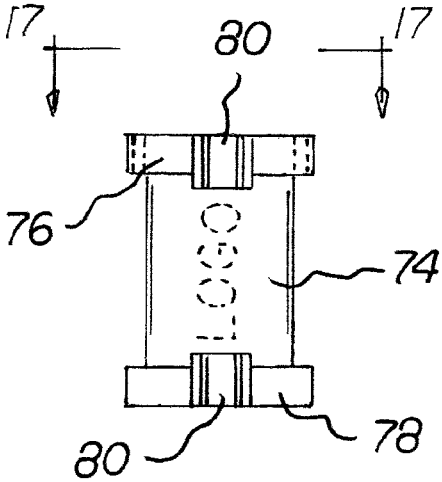
FIG. 16 is a front elevational view of the support for a drink holder.
Figure 17:
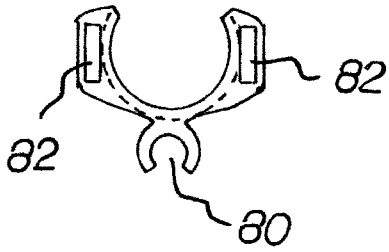
FIG. 17 is a plan view taken along line 17-17 of FIG. 16.

With reference now to the drawings, and in particular to FIG. 1 thereof, the preferred embodiment of the new and improved beach umbrella system embodying the principles and concepts of the present invention and generally designated by the reference numeral 10 will be described.

The present invention, the beach umbrella system 10 is comprised of a plurality of components. Such components in their broadest context include an umbrella and a plurality of support components. Such components are individually configured and correlated with respect to each other so as to attain the desired objective.

The beach umbrella system 10 of the present invention is for providing shade at a beach, for deploying rapidly, and for supporting leisure articles. The providing and deploying and supporting are done in a safe, convenient, and economical manner.

From a specific standpoint, first provided in the preferred embodiment of the beach umbrella system 10 is an umbrella 14. The umbrella has a lower pole 16, an upper pole 18, and a fabric 20. The lower pole is formed with a lower end and includes a lower insert 22. The lower insert is formed with screw threads 24 and is fabricated of plastic. Axial grooves 26 and axial projections 28 interface the lower pole and the lower insert to abate rotation between the lower pole and the lower insert. Pins 30 couple the lower pole and the lower insert to abate axial movement between the lower pole and the lower insert. Interior holes 32 extend through the upper pole at a lower extent. Exterior holes 34 extend through the lower pole at an upper extent. A spring clip 36 fabricated of spring steel is in an inverted V-shaped configuration with outwardly extending projections 38 extending through the interior holes and the exterior holes to removably couple together the upper pole and the lower pole. Drilling holes 40 extend through the lower pole beneath the spring clip. A handle 42 in a cylindrical configuration is removably positioned through the drilling holes to twist the lower pole for insertion into the sand.

Next provided are a plurality of ribs 46. Each of the ribs has an interior end and an exterior end. The interior ends are coupled to the upper pole at an upper extent. The exterior ends form a generally circular configuration. The fabric 20 has a generally circular configuration overlying the ribs. The fabric has a periphery. Each tip of a plurality of tips 48 has an upper part 50 and a lower part 52. Each upper part has a tubular recess 54 receiving the exterior end of an associated rib. The periphery of the fabric is positioned between the upper parts and the lower parts respectively. Staples 56 couple together the lower part and the fabric and the upper part.

Next provided is a collar 60 having a cylindrical configuration with an axial threaded aperture 62. A threaded bolt 64 extends through the axial threaded aperture of the collar to removably secure the collar to the upper pole beneath the ribs. A spacer 66 in a generally cylindrical configuration is positionable between the upper pole and the collar to accommodate an upper pole of a smaller diameter. The spacer has an axial slot 68 for passage of the threaded bolt. A plurality of J-shaped hooks integrally formed with the collar are adapted to support a variety of objects including towels, purses, cameras, and the like.

Lastly, a plurality of drink holders 72 are provided. Each drink holder includes a supporting member 74. Each supporting member has a C-shaped configuration for removable coupling frictionally to the lower pole beneath the spring clip. The support member has an upper enlargement 76 and a lower enlargement 78. Two small C-shaped fingers 80 are provided. One of the fingers is a small C-shaped finger coupled to the upper enlargement. The other finger is a small C-shaped finger coupled to the lower enlargement. The small C-shaped fingers are axially aligned for removable receipt of the handle 42. The upper enlargement has diametric slots 82 extending vertically. Each of two inverted J-shaped backings 84 has a short leg 86 removably received in an associated slot and a long leg 88 extending below the lower enlargement. A circular base 90 is pivotably coupled to each long leg below the lower enlargement. A circular ring 92 is pivotably coupled to each long leg above the lower enlargement. Each circular base and each circular ring are positioned horizontally during operation and use. Each circular base is pivoted upwardly and each circular ring is pivoted downwardly during storage and transportation. In this manner, each circular base is within an associated circular ring.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A beach umbrella system comprising:

an umbrella having a lower pole and an upper pole and a fabric, the lower pole including screw threads, a spring clip in an inverted V-shaped configuration with outwardly extending projections removably coupling together the upper pole and the lower pole, a handle removably coupled to the lower pole to twist the lower pole;

a plurality of ribs, each rib having an interior end and an exterior end, the interior ends coupled to the upper pole, the fabric overlying the ribs, the fabric having a periphery, a plurality of tips, each tip having an upper part and a lower part, each upper part having a tubular recess receiving the exterior end of an associated rib, the periphery of the fabric secured between the upper part and the lower part;

a collar having a cylindrical configuration with a threaded aperture, a threaded bolt extending through the threaded aperture of the collar to removably secure the collar to the upper pole beneath the ribs, a plurality of J-shaped hooks integrally formed with the collar adapted to support a variety of objects including towels, and cameras; and a spacer in a generally cylindrical configuration positionable between the upper pole and the collar to accommodate upper poles of smaller diameters, the spacer having an axial slot for passage of the bolt.

2. A beach umbrella system comprising:

an umbrella having a lower pole and an upper pole and a fabric, the lower pole including screw threads, a spring clip in an inverted V-shaped configuration with outwardly extending projections removably coupling together the upper pole and the lower pole, a handle removably coupled to the lower pole to twist the lower pole;

a plurality of ribs, each rib having an interior end and an exterior end, the interior ends coupled to the upper pole, the fabric overlying the ribs, the fabric having a periphery, a plurality of tips, each tip having an upper part and a lower part, each upper part having a tubular recess receiving the exterior end of an associated rib, the periphery of the fabric secured between the upper part and the lower part; and a plurality of drink holders, the plurality of drink holder having a supporting member, the supporting member having a C-shaped configuration for removable coupling to the lower pole beneath the spring clip, the support member having an upper enlargement and a lower enlargement, small C-shaped fingers coupled to the upper enlargement and the lower enlargement respectively, the small C-shaped fingers being axial aligned for removable receipt of the handle, the upper enlargement having diametric slots extending vertically, two inverted J-shaped backings, each inverted J-shaped backing having a short leg removably received in an associated slot, each inverted J-shaped backing having a long leg extending below the lower enlargement, a circular base pivotably coupled to the inverted J-shaped backing below the lower enlargement, a circular ring pivotably coupled to the inverted J-shaped backing above the lower enlargement, the circular base and the circular ring being positioned horizontally during operation and use, the circular base being pivoted upwardly and the circular ring being pivoted downwardly during storage and transportation whereby the circular base is within the circular ring.

3. A beach umbrella system (10) for providing shade at a beach, for deploying rapidly, and for supporting leisure articles, the providing and deploying and supporting being done in a safe, convenient, and economical manner, the system comprising, in combination:

an umbrella (14) having a lower pole (16) and an upper pole (18) and a fabric (20), the lower pole formed with a lower end and including a lower insert (22), the lower insert being formed with screw threads (24) and fabricated of plastic, axial grooves (26) and axial projections (28) interfacing the lower pole and the lower insert to abate rotation between the lower pole and the lower insert, pins (30) coupling the lower pole and the lower insert to abate axial movement between the lower pole and the lower insert, interior holes (32) extending through the upper pole at a lower extent, exterior holes (34) extending through the lower pole at an upper extent, a spring clip (36) fabricated of spring steel in an inverted V-shaped configuration with outwardly extending projections (38) extending through the interior holes and the exterior holes to removably couple together the upper pole and the lower pole, drilling holes (40) extending through the lower pole beneath the spring clip, a handle (42) in a cylindrical configuration removably positioned through the drilling holes to twist the lower pole for insertion into the sand;

a plurality of ribs (46), each of the ribs having an interior end and an exterior end, the interior ends coupled to the upper pole at an upper extent, the exterior ends forming a generally circular configuration, the fabric (20) having a generally circular configuration overlying the ribs, the fabric having a periphery, a plurality of tips (48), each tip having an upper part (50) and a lower part (52), each upper part having a tubular recess (54) receiving the exterior end of an associated rib, the periphery of the fabric positioned between the upper parts and the lower parts respectively with staples (56) coupling together the lower part and the fabric and the upper part;

a collar (60) having a cylindrical configuration with an axial threaded aperture (62), a threaded bolt (64) extending through the axial threaded aperture of the collar to removably secure the collar to the upper pole beneath the ribs, a spacer (66) in a generally cylindrical configuration positionable between the upper pole and the collar to accommodate an upper pole of a smaller diameter, the spacer having an axial slot (68) for passage of the threaded bolt, a plurality of J-shaped hooks integrally formed with the collar adapted to support a variety of objects including towels, purses, and cameras; and a plurality of drink holders (72), each drink holders including a supporting member (74), each supporting member having a C-shaped configuration for removable coupling frictionally to the lower pole beneath the spring clip, the support member having an upper enlargement (76) and a lower enlargement (78), two small C-shaped fingers (80), one small C-shaped finger coupled to the upper enlargement and one small C-shaped finger coupled to the lower enlargement, the small C-shaped fingers being axially aligned for removable receipt of the handle (42), the upper enlargement having diametric slots (82) extending vertically, two inverted J-shaped backings (84), each inverted J-shaped backing having a short leg (86) removably received in an associated slot, each inverted J-shaped backing having a long leg (88) extending below the lower enlargement, a circular base (90) pivotably coupled to each long leg below the lower enlargement, a circular ring (92) pivotably coupled to each long leg above the lower enlargement, each circular base and each circular ring being positioned horizontally during operation and use, each circular base being pivoted upwardly and each circular ring being pivoted downwardly during storage and transportation whereby each circular base is within an associated circular ring.

* * * * *